United States Patent [19]

McCarley

[11] 4,442,619

[45] Apr. 17, 1984

[54] CARTRIDGE EXTRACTION TOOL

[76] Inventor: Roy J. McCarley, Red Eagle Rte., Box 68, Pawhuska, Okla. 74056

[21] Appl. No.: 332,960

[22] Filed: Dec. 21, 1981

[51] Int. Cl.[3] ..... F41C 27/00; B25B 27/00

[52] U.S. Cl. ..... 42/1 R; 81/3.05

[58] Field of Search ..... 42/1 R, 90; 86/24; 81/3.05

[56] References Cited

U.S. PATENT DOCUMENTS

| | | | |
|---|---|---|---|
| 209,989 | 11/1878 | Shinn | 81/3.05 |
| 259,172 | 6/1882 | Kirkwood | 81/3.05 |
| 985,190 | 2/1911 | Mauser | 42/1 R |
| 1,435,327 | 11/1922 | Nelson | 42/25 |
| 2,483,837 | 10/1949 | Nettles | 42/25 |
| 2,484,444 | 11/1949 | Benson | 42/25 |
| 2,603,020 | 7/1952 | Hussey | 42/25 |
| 2,807,902 | 10/1957 | Kopf | 42/25 |
| 3,142,923 | 8/1964 | Vartanian et al. | 42/25 |
| 3,564,950 | 2/1971 | Jorczak et al. | 42/1 R |

FOREIGN PATENT DOCUMENTS

| | | | |
|---|---|---|---|
| 80406 | 7/1952 | Norway | 81/3.05 |

*Primary Examiner*—Charles T. Jordan

*Attorney, Agent, or Firm*—Head, Johnson & Stevenson

[57] ABSTRACT

A movable knocker type cartridge extraction tool that inserts through the back of a breach loading rifle after the bolt has been removed and circumferentially grips the rim of the stuck cartridge such as to extract the live round of ammunition without disarming the cartridge.

3 Claims, 6 Drawing Figures

CARTRIDGE EXTRACTION TOOL

BACKGROUND OF THE INVENTION

1. Field of the Invention

This invention relates to a tool for extracting a cartridge from a rifle. More specifically, the invention relates to a knocker type extraction tool for removing a stuck live cartridge from the barrel of a bolt action rifle.

2. Description of the Prior Art

Although contemporary firearms are generally considered to be highly reliable mechanical devices, it is known and well recognized that certain mechanical failures or other related events can result in the hang-up and sticking of a live round of ammunition. Various methods of correcting such a situation, once it has occurred, have been previously proposed and employed with varying degrees of success and associated risk, frequently depending on the particular nature and type of weapon involved.

In the case of a breech loaded bolt action type mechanism, the problem can be seriously aggravated and may consequently represent a very high risk situation. This is particularly true in the case of a missized casing such as when the casing has been reloaded improperly or the like. For example, if an oversized or deformed cartridge becomes stuck during the breech loading process, there is a tendency to force the cartridge into the barrel by the application of additional manual exertion on the bolt. If one then attempts to remove the stuck cartridge by ramming a wooden dowel rod or the like back through the barrel, an additional swage-like seizing can take place between the bullet, cartridge casing, and rifle bore. In such event, the live cartridge must be first disarmed by carefully microdrilling the firing cap to remove the primer charge. Such a procedure is very risky and inherently involves the gunsmith being extremely close to the live stuck cartridge throughout the procedure.

SUMMARY OF THE INVENTION

In view of the problems associated with removal of a live cartridge stuck in a bolt action firearm, I have discovered an improved cartridge extraction tool comprising:

(a) a rod with an end cap;

(b) a movable knocker circumferentially displaced about the rod and adapted to manually slide on the rod and strike the end cap thus creating an extraction force longitudinal to the rod; and (c) an attachment means at the other end of the rod, adapted to insert into the breech of the firearm after the bolt is removed, with the rod being held coaxial with the bore of the rifle for circumferentially attaching and locking to the rim of the stuck cartridge.

The present invention further provides a compressible fastening means for circumferentially fitting over the rim of the stuck cartridge when in the uncompressed state and under compression closing and gripping the stuck cartridge; and a means for compressing the compressible fastening means. In one preferred embodiment the compressible fastening means attached to the end of the rod is an externally threaded cylindrical surface that terminates in a hollow right frustro-conical surface with the larger end directed away from the threads and rod and wherein the frustro-conical surface contains a plurality of cuts longitudinal to the direction of the rod such as to allow for compression of the frustro-conical surface and wherein the outer segmented edge of the longitudinally cut frustro-conical surface contains a segmented circumferential ledge directed into the hollow interior of the frustro-conical surface such as to close around and grip the rim of the stuck cartridge when compressed; and wherein the means for compressing the frustro-conical surface is an internally threaded member circumferentially engaged to the external threaded cylindrical surface such that when threaded towards the larger end moves a cylindrical concentric member surrounding the first frustro-conical surface and having an interior second frustro-conical surface engaged to the first frustro-conical surface such that said compression takes place. The present invention further provides that a cylindrical spacer be located between the internally threaded member and the cylindrically concentric member surrounding the first frustro-conical surface and that these components be perforated.

It is a primary object of the present invention to provide an extraction tool adapted to remove a live round of ammunition stuck in a firearm without necessitating the use of a microdrill to disarm the cartridge before extraction. It is a further object that this extraction tool be readily adapted to use in a breech loading rifle after the bolt is removed. Fulfillment of these objects and the presence and fulfillment of other objects will be apparent upon complete reading of the specification and claims in conjunction with the attached drawing.

DESCRIPTION OF THE PREFERRED EMBODIMENT

Figure 1:
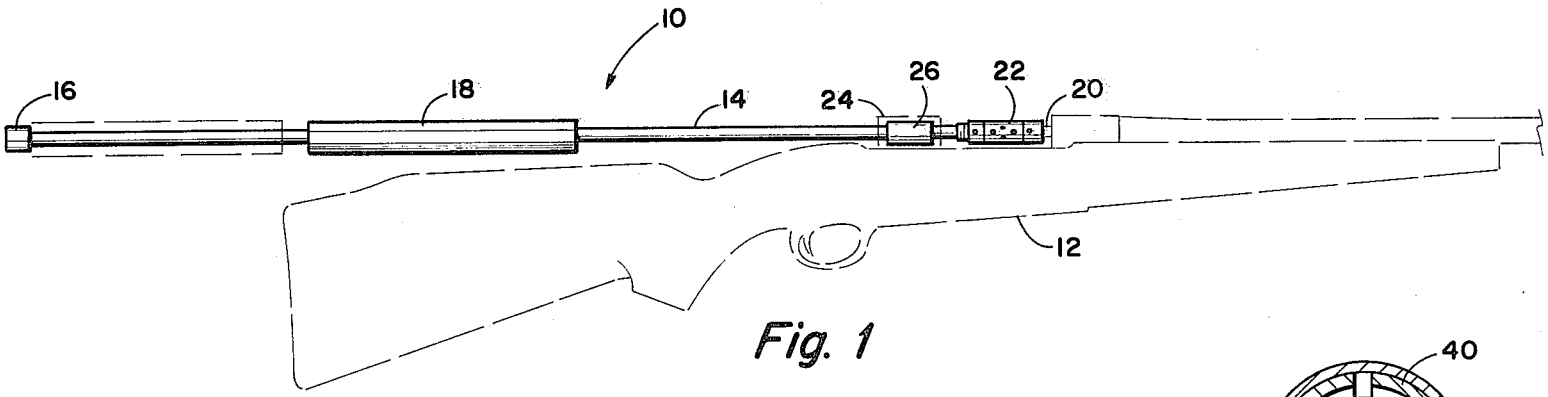
FIG. 1 is a silhouetted side view of a bolt action rifle having the cartridge extraction tool according to the present invention in place for removal of a stuck cartridge.

The cartridge extraction tool according to the present invention, how it attaches to a firearm, and how it is used to extract a stuck cartridge can perhaps be best explained and understood by reference to the drawing.

Figure 2:
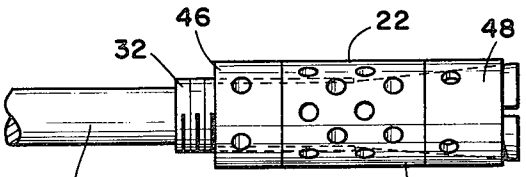
FIG. 2 is a close-up view of the cartridge attachment means of FIG. 1.

FIG. 1 illustrates the cartridge extraction tool, generally designated by the numeral 10, inserted into a breech loading bolt action rifle 12 silhouetted in dashed lines. The extraction tool 10 is made up of a rod 14 capped at one end by a slide stop 16. A manually movable knocker 18 having rod 14 passing therethrough is positioned such that when slapped back against the stop 16 (see silhouette) an extracting force will be applied to the stuck cartridge by virtue of the novel cartridge attachment means 22 being fastened to the other end of the rod 14 and securely gripping the stuck cartridge 20. This attachment means 22 is designed such that it will insert through the opening breech bolt support 24 of rifle 12 after the bolt (not shown) has been removed. An alignment bushing or sleeve 26 is positioned within the breech support 24 to act as a bearing surface and thus reduce side sway during striking of the knocker 18 against the end cap stop 16. Various presized alignment bushings 26 can be employed according to the make and model of the particular rifle or optionally a tapered universal sleeve can be employed. A close-up view of the cartridge attachment tool 22 of FIG. 2 shows a series of perforations in the outer elements of the attachment tool 22 to allow for expansion and release of hot gases if the live cartridge accidentally fires and also to serve as a means to securely tighten the attachment tool 22 to the stuck cartridge as explained later.

Figure 5:
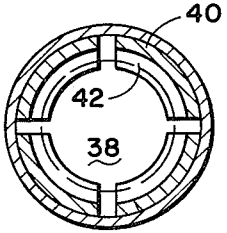
FIG. 5 is a cross-sectional view of the cartridge attachment means of FIG. 4 as viewed through line 5—5.
Figure 3:
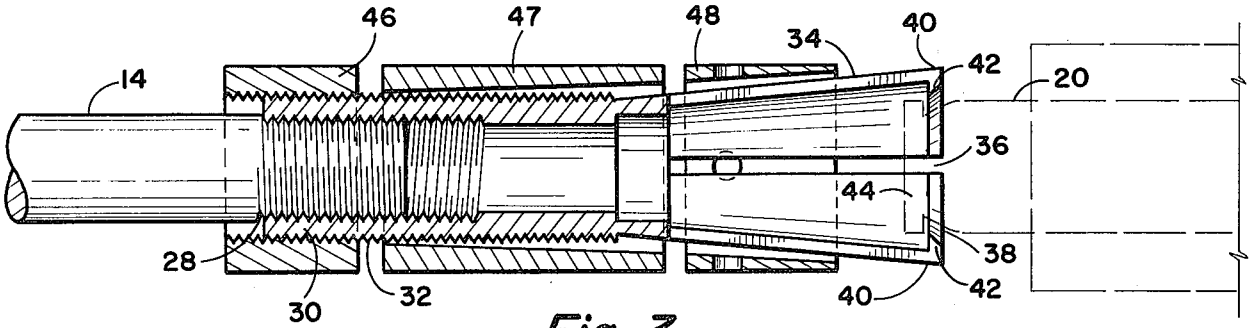
FIG. 3 is a cross-sectional side view of the cartridge attachment means positioned about a stuck cartridge in an uncompressed state.
Figure 4:
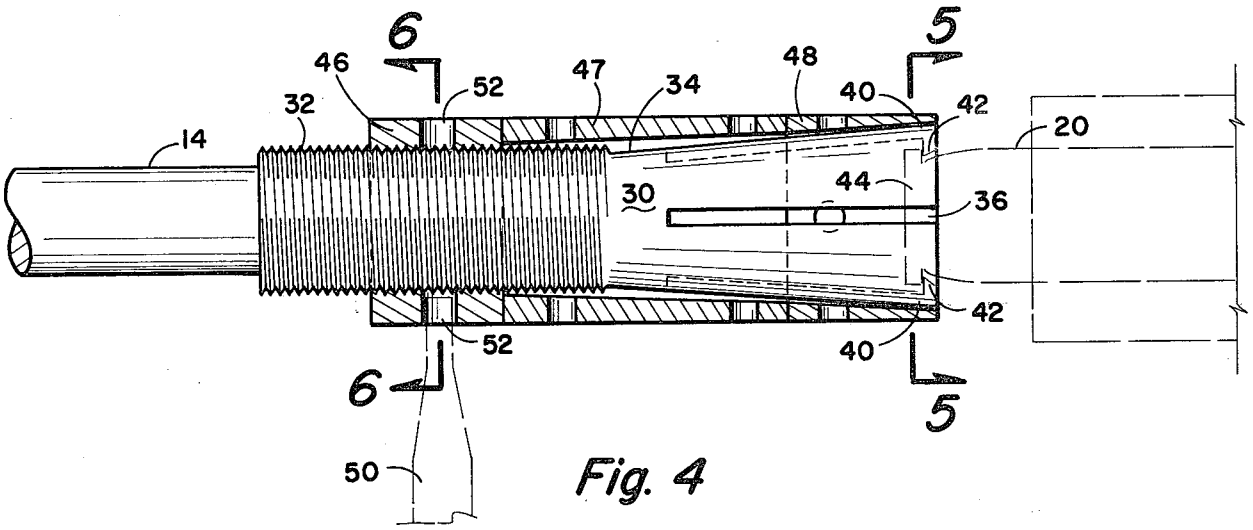
FIG. 4 is a partial cross-sectional side view of the cartridge attachment means positioned about a stuck cartridge in a compressed state circumferentially seizing the rim of the stuck cartridge.

FIGS. 3 and 4 illustrate the individual elements of a preferred embodiment of the novel attachment tool. As illustrated, rod 14 is threaded at one end 28 in order to attach to the cylindrical member 30 containing external threads 32. The other end of member 30, directed towards the stuck cartridge, is a hollow, right frustro-conical surface 34 with the larger end belled and directed away from the threads 32 and rod 14. This frustro-conical surface 34 contains a plurality of cuts 36 longitudinal to the direction of the rod 14 such as to allow for compression of the surface 34 which tends to reduce and close the diameter of the belled circular opening 38 (see FIG. 5). The outer segmented edge 40 of the longitudinally cut frustro-conical surface 34 contains a segmented circumferentially attached ledge 42 directed into the hollow interior such as to close around and grip the rim 44 of the stuck cartridge 20 when under compression (see FIG. 4).

Circumferentially displaced around the compressible fastening member 30 is a set of three elements making up the means for applying a compressive force. To the left is an internally threaded cylindrical member 46 engaged to the external threads 32 such as to thread back and forth on member 30. At the other end of compressible member 30 is a cylindrically concentric member 48 surrounding the frustro-conical surface 34. This tightening element 48 has a second interior frustro-conical surface adapted to engage to the first frustro-conical surface 34 and compress it as element 48 is driven to the right towards the stuck cartridge 20. The intermediate cylindrical sleeve 47 positioned between the threaded member 46 and tightening member 48 transmits the force supplied by member 46 when it is threaded towards element 48.

Figure 6:
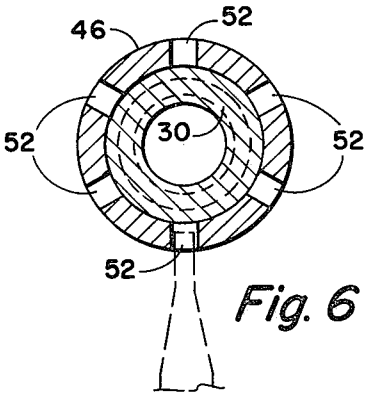
FIG. 6 is a cross-sectional view of the cartridge attachment means of FIG. 4 as viewed through line 6—6.

In order to use the extraction tool 10, the bolt of the bolt action rifle is removed and the tool is positioned within the rifle as illustrated in FIG. 1 and the attachment means is positioned about the stuck cartridge as illustrated in FIG. 3. The nut or threaded member 46 is then threaded toward the cartridge by inserting a punch like tool 50 (see FIG. 5) in the holes or perforations 52 of member 46 (see FIGS. 5 and 6) and repeatedly turned in the appropriate direction. Once the attachment means has securely gripped the rim of the stuck cartridge the knocker mass can be slapped against the end cap to extract the cartridge.

The present invention has the distinct advantage of readily extracting a live round of ammunition without performing the risky act of drilling and disarming the cartridge. As such the tool is amenable to safe operation and has proved to be highly reliable for its intended purpose.

Having thus described the preferred embodiment of the invention with a certain degree of particularity, it is manifest that changes can be made in the details of construction and arrangement of components without departing from the spirit and scope of this disclosure. Therefore, it is to be understood that the invention is not limited to the embodiment set forth herein for purposes of exemplification, but is to be limited only by the scope of the attached claims including the full range of equivalents to which each element thereof is entitled.

I claim:

1. A cartridge extraction tool adapted to remove a live round of ammunition struck in the barrel of a breech loading bolt action firearm comprising:

(a) a rod with an end cap;

(b) a movable knocker circumferentially displaced about said rod and adapted to manually slide on said rod and strike said end cap thus creating an extraction force longitudinal to said rod;

(c) a compressible fastening means for circumferentially fitting over the rim of a stuck cartridge when in the uncompressed state and under compression closing and gripping a stuck cartridge wherein said compressible fastening means is attached at the other end of said rod and is an externally threaded cylindrical surface that terminates in a hollow right frustro-conical surface with the larger end directed away from said threads and rod, and wherein said frustro-conical surface contains a plurality of cuts longitudinal to the direction of the rod such as to allow for compression of said frustro-conical surface, and wherein the outer segmented edge of said longitudinally cut frustro-conical surface contains a segmented circumferential ledge directed into the hollow interior of said frusto-conical surface such as to close around and grip the rim of a stuck cartridge when compressed; and (d) a means for compressing said compressible fastening means wherein said means for compressing said frustro-conical surface consists of (i) an internally threaded member circumferentially engaged to said external threaded cylindrical surface such that when threaded towards said larger end moves a cylindrical concentric member surrounding said first frustro-conical surface and (ii) a cylindrical concentric member surrounding said first frustro-conical surface having an interior second frustro-coincal surface engaged to said first frustro-conical surface such that said compression takes place.

2. A cartridge extraction tool of claim 1 wherein a cylindrical spacer is located between said internally threaded member and said cylindrically concentric member surrounding said first frustro-conical surface.

3. A cartridge extraction tool of claim 2 wherein said cylindrical spacer, internally threaded member, and cylindrical concentric member are perforated.

* * * * *